United States Patent [19]

Warncke

[11] 4,083,065

[45] Apr. 11, 1978

[54] PROTECTIVE HELMET AND FULL FACE MASK CONSTRUCTION

[75] Inventor: Ernst Warncke, Lubeck, Germany

[73] Assignee: Dragerwerk Aktiengesellschaft, Germany

[21] Appl. No.: 740,133

[22] Filed: Nov. 8, 1976

[30] Foreign Application Priority Data

Nov. 7, 1975 Germany ..... 2549979

[51] Int. Cl.[2] ..... A42B 1/08

[52] U.S. Cl. ..... 2/424

[58] Field of Search ..... 2/424, 10, 6, 9, 427, 2/428, 429; 128/146.7, 142.7

[56] References Cited

U.S. PATENT DOCUMENTS

| | | | |
|---|---|---|---|
| 2,814,293 | 11/1957 | Gabb et al. | 128/146.7 |
| 3,167,069 | 1/1965 | Lobelle | 128/146.7 |
| 3,513,841 | 5/1970 | Seeler | 128/146.7 |
| 3,624,663 | 11/1971 | Jones | 2/424 |
| 3,805,294 | 4/1974 | Rose et al. | 2/10 |

*Primary Examiner*—Werner H. Schroeder
*Assistant Examiner*—Peter Nerbun
*Attorney, Agent, or Firm*—McGlew and Tuttle

[57] ABSTRACT

A protective helmet and a full face mask for combined use on the head and face of a person, comprises a mask which is adapted to fit over the face and has a peripheral portion for encircling the chin, jaws and forehead of the face. The helmet engages over the person's head and has at least one portion adapted to overlie an edge of the mask. The mask has a receiving bearing recess in the overlying portion of the helmet and the helmet has a locking mechanism which comprises a member which is rotatably mounted on the helmet and has a pin which is slidable toward and away from the recess. The pin is urged under spring action into the recess and, when the member is rotated, the pin rides in the recess to pull the mask toward the helmet and toward tighter engagement with the person's head.

6 Claims, 3 Drawing Figures

PROTECTIVE HELMET AND FULL FACE MASK CONSTRUCTION

FIELD AND BACKGROUND OF THE INVENTION

This invention relates in general to the construction of a helmet and a full face mask and, in particular, to a new and useful helmet and mask construction which makes it easy to apply either the helmet or mask separately and to secure the mask into a position tightly engaging the face and close to the helmet.

DESCRIPTION OF THE PRIOR ART

At the present time, the wearing of a protective helmet is practically a routine matter. In addition, for many activities, it is still necessary to wear full face mask. The helmet and the mask shoud be so adapted to each other that the mask can be attached quickly, simply and safely without having to remove the helmet.

The known masks are secured on the head by means of straps, which comprise at least forehead, temple and neck straps. If, in addition, a protective helmet is worn, for example, like a hard hat or a fireman's helmet, the latter rests with its own holding device above the face piece straps. It is clear, that in these embodiments, the helmet must be removed before the mask can be attached. Any change in the adjustment of the straps, both of the mask and of the helmet is difficult, since both strap systems must be adapted to each other. It is readily possible that buckles or straps will either interfere with the sealing of the oxygen mask or the holding of the helmet and thus impair them.

A known head protective device with helmet has holding means in the forehead region, both of the helmet and of the mask, which interlock when the helmet and later the mask are attached and yield a detachable connection. To this end, the helmet is equipped with a holder which engages a depression on the edge of the mask. The holder can be designed as an adjusting screw for individual adaptation. In order to further secure the fit, additional detachable connecting means with the bottom edge can be provided, which act on the bottom edge of the mask.

The mask can be attached without having to remove the helmet. The holding means connect the helmet and mask with each other by bearing against the forehead of the wearer. A reliable adaptation of the strapless mask on the circumferential sealing line on the face is not achieved with this design. The other connecting means at the bottom mask edge have only a minor sealing effect (DOS 23,31,605).

SUMMARY OF THE INVENTION

The present invention provides means for connecting the full face mask to be applied, with the helmet attached, in such a way that a tight fit and a reliable seal are achieved. In addition, the strapless mask can be adapted to the respective head and face of the wearer.

The invention includes a helmet with a rotatable locking mechanism with an elastically mounted drop-in pin which engages at both sides an oblong recess of a bearing construction on the mask extending substantially parallel to the mask edge and arranged in its proximity. The bearing is preferably arranged in the temple-jaw region of the mask.

The full face mask in cobmination with the helmet forms a practically harmonic system for the wearer.

The helmet does not change its fitting position, even after the mask has been applied. On the contrary, it is held more firmly by connection with the latter. The movement of the drop-in pin connecting the two parts by turning the grip sleeves to the rear has the effect that the mask bears on the face with tolerable and adjustable pressure. Due to the arrangement of the connection to the temple-jaw region, it is tightened from the forehead over the cheeks. This results in a tight circumferential fit of the mask. In addition, the chin portion may be further tightened by a chin strap of the helmet.

In an advantageous embodiment of the invention, the locking mechanism comprises a rotor with flange arranged in the helmet wall, in which the drop-in pin is guided eccentrically under spring action, and of an overlapping axially sprung grip sleeve, which is engaged in an opening by a radial follower pin of the drop-in pin. The opening has the form of a triangle with a first side parallel to the axis of rotation, and a second side inclined as a striking surface.

The design of the locking mechanism is technically simple, both in the manufacture and in handling. It ensures a reliable functioning, particularly to achieve a tight seal, even with different and difficult head forms.

In another embodiment, the helmet wall and the flange and/or the grip sleeve have interlocking embossings or detents to fix the position of the locking mechanism achieved by tightening of the mask. The embossings are fully divided and permit therefore a fine adaptation. The elastic holding of the embossings over the compression spring permits easy adjustment and fixing, as well as detachment.

Accordingly, it is an object of the invention to provide a mask and helmet construction for combined use on the face and head of a person, which includes a mask which has a periphery which encircles the jaws, forehead and chin, and a helmet which is positioned on the head and which has a side portion overlapping a portion of the mask with a rotatable locking mechanism which includes a pin engageable in a bearing recess defined on the mask adjacent the periphery thereof and which will cause inward movement of the mask toward tighter engagement with the face and a more snug fit with the helment by the rotation of the locking mechanism.

A further object of the invention is to provide a mask and helmet construction in which the mask fits the face easily and comfortably but sufficiently tight and it may be readily connected or disconnected to the helmet and either may be applied separately without difficulty.

A further object of the invention is to provide a protective helmet and breathing protection mask construction, which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there is illustrated a preferred embodiment of the invention.

DESCRIPTION OF THE PREFERRED EMBODIMENT

Figure 1:
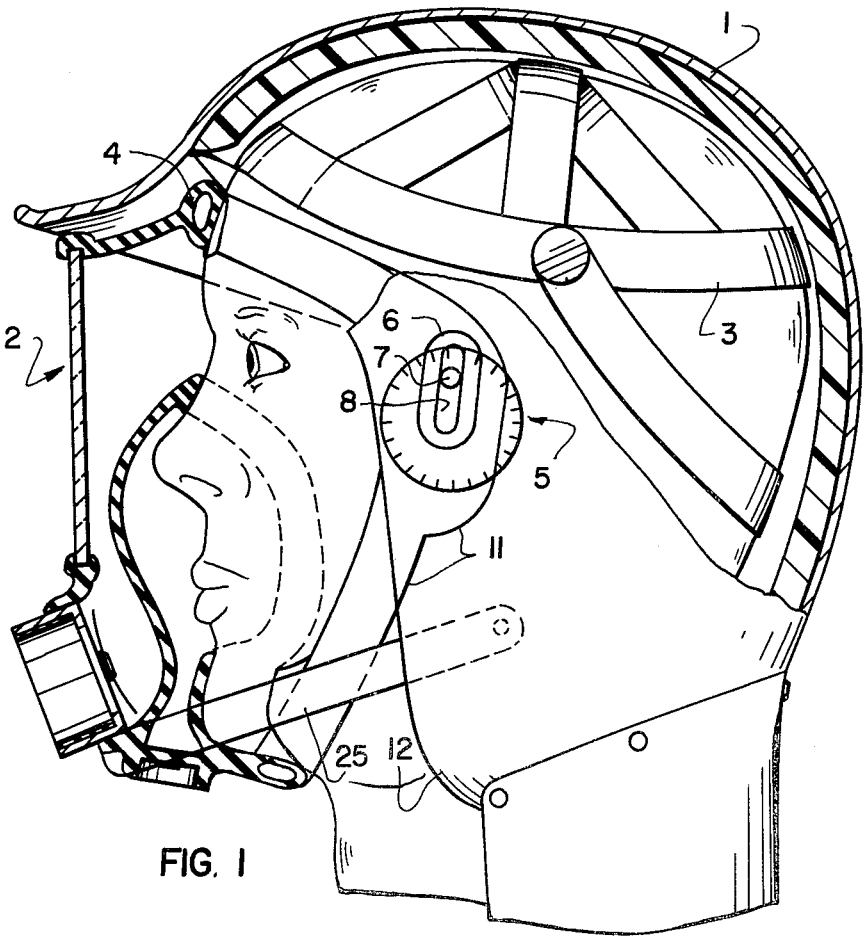
FIG. 1 is a side elevational view, partly in section, showing a combined helmet and mask combination for use on a wearer, constructed in accordance with the invention.

Referring to the drawing in particular, the invention embodied therein, comprises a helmet 1 which is fitted over the head of a person and a mask, generally designated 2, which is fitted over the face of a person and which includes an encircling peripheral portion in the form of a beaded part 4 which engages around the chin, jaws and forehead of the wearer. Helmet 1 is equipped with a headset or strapping 3 for easy fit thereof on a person's head. The mask 2 is strapless, but is otherwise designed in a well-known manner and will not be described in detail. The beaded portion 4 at the periphery comprises a sealing frame which bears on the face.

In accordance with the invention, a connection between the helmet 1 and the mask 2 is effected preferably on both sides by a locking mechanism, generally designated 5, which is carried on a portion of the helmet 1 which overlaps a peripheral portion of mask 2. The locking mechanism includes a drop-in pin 7 which is engageable in a stop bearing or recess 6 defined on a peripheral portion of mask 2 which, for example, may lie outside of the bead 4.

Stop bearing or recess 6 comprises an oblong slot or recess forming a bearing bed 8 between circumferential shoulders 9 and 10. Shoulder 9 may, for example, be lower than shoulder 10 in order to facilitate the attachment of the mask 2. The drop-in pin 7 is movable backwardly against the force of a compression spring 17 which is arranged over a support pin 30 in a cavity 16 of a rotatable member or rotor 13. Spring 17 urges the pin 7 in a direction to move its end outwardly from rotatable member 13 so that it will engage in the stop bearing 6. For attachment purposes, the spring may be deflected inwardly by the mask or by a person's finger against the force of the biasing spring 17. Stop bearing 6 is advantageously arranged in the temple-jaw region next to the mask edge 11 and the oblong slot or bearing bed 8 extends substantially parallel to the mask edge 11.

Figure 2:
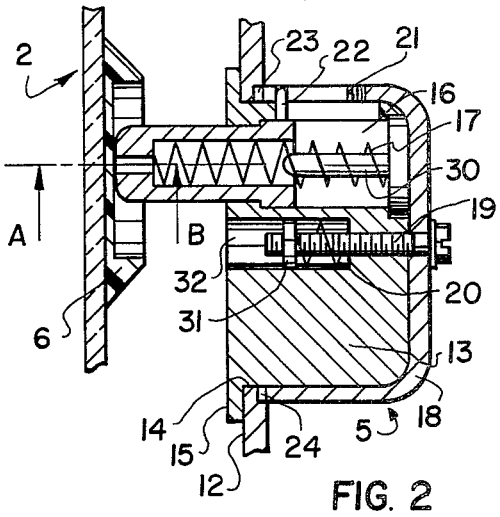
FIG. 2 is an enlarged sectional view of the locking mechanism for the helmet and mask.
Figure 3:
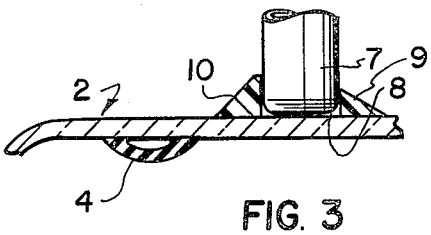
FIG. 3 is a section taken along the line A–B of FIG. 2.

Locking mechanism 5, which is arranged in the helment wall 12, opposite stop bearing 6, is shown in detail in FIG. 2. The rotor 13 protrudes through a bore 14 of the helmet and it has a peripheral flange 15 which bears against the interior of the helmet wall 12. A separate grip sleeve 18 embraces the rotor 13 and it is held on the rotor for axial rotation by a screw or bolt 19 which extends through the center of the sleeve 18 and the rotor 13. A compression spring 20 is engaged between a nut member 31 of bolt 19 and the inner end of a cavity 32 defined in the inner face of the rotor 13. A compression spring disposed between nut member 31 and the interior of the cavity urges the rotor 13 inwardly into engagement with sleeve 18 so that they rotate together or, if necessary, they may be rotated opposite to each other. Grip sleeve 18 has an opening 21 in the form of a triangle. One side is parallel and another side is designed as a striking surface inclined to the axis of rotation. Drop-in pin 7 has a radially arranged follower pin 22 which protrudes into opening 21.

Grip sleeve 18 and the opposite circumferential part 23 of the helmet wall 12 has embossings or detents 24, for example, in the form of interlocking teeth. They lock rotor 13 in the position reached by the rotation of grip sleeve 18. The embossings can also be worked into flange 15 and the inside of helmet wall 12 with a corresponding design, if desired.

The apparatus may also include a chin strap 25 which is affixed to helmet 1 and may be adjusted in length so that, when pulled over the bottom part of the mask and braced thereon, it provides an additional holding force for the helmet and mask.

To apply the mask 2 with the helmet attached, the mask is pulled over the face. The drop-in pins 7 engage from both sides through stop bearings 6 which are arranged in the temple-jaw region. The tightening of mask 2 to achieve a tight fit on frame 4 is effected by rotating sleeve 18. The rotary movement is transmitted to rotor 13 after the follower pin 22 has struck the axis parallel side of the opening 21 which pulls the drop-in pins 7 to the rear on their circumferential path and also pulls the mask 2 at the same time to engage it more tightly on the face and to advance it toward the helmet.

By turning grip sleeves 18 in the opposite direction, the follower pins 22 move over the inclined striking surfaces of the openings 21 to cause it to ride upwardly in the slot formed by opening 21 and move into rotor 13 so that the helmet may be easily detached from stop bearing 6. After unlocking, the mask can be easily removed.

The inclined striking surface which is formed on each side of the slot opening 21 permits intermediate positions of the drop-in pin 7 to regulate the amount in which it projects outwardly from its associated cavity 16 of rotor 13. This can be of advantage for the adaptation of the helmet and mask to the respective shape and size of the wearer's head.

While a specific embodiment of the invention has been shown and described in detail to illustrate the application of the principles of the invention, it will be understood that the invention may be embodied otherwise without departing from such principles.

What is claimed is:

1. A protective helmet and full face mask for combined use on the face and head of a wearer, comprising a mask adapted to fit over the face and having a peripheral portion for encircling the chin, jaw and forehead of the face, a helmet adapted to engage over the head and having at least one portion adapted to overlie a portion of said mask, said mask having a receiving bearing recess in the overlying portion, said helmet having a locking mechanism comprising a member rotatably mounted on said helmet having a cavity extending toward said mask eccentric to the axis of said member, a pin of substantially the same width as the bearing recess and being movable in said cavity between a locking position in which it projects out of said cavity for engagement into said bearing recess and an unlocked position withdrawn into said cavity, said member being rotatable with said pin engaged in said recess to move said mask toward said helmet for tighter engagement with the wearer's face, a cam follower carried by said pin, and cam means engageable with said cam follower for moving said pin in said cavity.

2. A protective helmet and full face mask, according to claim 1, wherein said bearing recess is elongated in a plane extending along the edge of said mask.

3. A protective helmet and mask, according to claim 1, wherein said mask includes a region between the forehead and the jaw, said bearing being defined in said region.

4. A protective helmet and mask, according to claim 1, wherein said locking mechanism comprises a cylindrical member having a flange, said helmet having an opening, said cylindrical member extending through said opening with the flange bearing against the interior wall of said helmet, said rotatable member having said cavity for said pin which is eccentric to the rotational axis of said rotatable member, spring means urging said pin in a direction out of the cavity of said member toward engagement in the bearing recess, an overlying grip sleeve engaged over said rotatable member on the exterior of said helmet, said sleeve having a sidewall with an opening therein and defining said cam means, said follower extending radially into said opening.

5. A protective helmet and mask, according to claim 4, wherein the opening of said sleeve has a bounding edge defining a said cam means, which is engaged by said follower, said follower being shiftable in the direction of the axis of said locking pin to move said locking pin inwardly and outwardly during rotation of said sleeve.

6. A protective helmet and mask, according to claim 1, wherein said rotatable member and said helmet have interengageable detent means for positioning said rotatable member at a selected rotational position for the purpose of holding said pin which is engaged in said bearing recess in a fixed position of adjustment of said mask.

* * * * *